United States Patent [19]

Tuckwood

[11] Patent Number: 4,828,506

[45] Date of Patent: May 9, 1989

[54] PRINTED CIRCUIT CONNECTOR WITH SPARK GAP FOR DISCHARGING EXCESS VOLTAGE

[75] Inventor: Denis W. Tuckwood, Beeston, England

[73] Assignee: Pressac Limited, Long Eaton, England

[21] Appl. No.: 109,971

[22] Filed: Oct. 19, 1987

[30] Foreign Application Priority Data

Jan. 24, 1987 [GB] United Kingdom ..... 8701558

[51] Int. Cl.[4] ..... H01R 13/648

[52] U.S. Cl. ..... 439/181; 439/108; 439/422; 439/752

[58] Field of Search ..... 439/56–58, 439/181, 182, 683, 684, 108, 422, 752; 313/325, 331

[56] References Cited

U.S. PATENT DOCUMENTS

| | | | |
|---|---|---|---|
| 2,840,793 | 6/1958 | Sunko et al. | 439/56 |
| 2,857,582 | 10/1958 | Wintress | 439/684 |
| 3,748,521 | 7/1973 | Wright et al. | 313/325 |
| 3,818,278 | 6/1974 | Adler | 439/182 |
| 3,916,238 | 10/1975 | Suzuki | 313/325 |
| 4,695,920 | 9/1987 | Klebba et al. | 361/118 |

FOREIGN PATENT DOCUMENTS

| | | |
|---|---|---|
| 0028946 | 7/1980 | European Pat. Off. . |
| 1363877 | 8/1974 | United Kingdom . |
| 1422153 | 1/1976 | United Kingdom . |
| 1423540 | 2/1976 | United Kingdom . |
| 1532228 | 11/1978 | United Kingdom . |
| 2023947 | 1/1980 | United Kingdom . |
| 1588615 | 4/1981 | United Kingdom . |
| 2061628 | 5/1981 | United Kingdom . |

*Primary Examiner*—Neil Abrams

*Attorney, Agent, or Firm*—Poms, Smith, Lande & Rose

[57] ABSTRACT

A connector (12) for flexible printed circuits comprises connector contacts (22) associated with a moulded plastics body (10) each having a first terminal (24) for connection to conductors of the printed circuit and a second terminal (28) e.g. providing part of a plug connector and a securing member (30) attached e.g. by ultrasonic welding retaining the contacts (22) in position and have moulded therein discharge contacts (36) each spaced from a respective one of the contacts (22) by a distance (which may be chosen according to the discharge voltage required) corresponding to a desired spark gap. Preferably the connector (12) has means (34) associated with the member (30) by which the connector is secured in a desired position e.g. on a car body. Preferably the contacts (36) are connected to a common conductor (38) which is earthed e.g. by contact with a screw used with the means (34) to secure the connector (12).

9 Claims, 2 Drawing Sheets

PRINTED CIRCUIT CONNECTOR WITH SPARK GAP FOR DISCHARGING EXCESS VOLTAGE

FIELD OF THE INVENTION

This invention relates to a printed circuit connector.

The expression "printed circuit" as used herein refers to any assembly comprising an electrical circuit disposed on a substrate.

Flexible circuits comprise an electrical circuit disposed on a flexible substrate. Typically the electrical circuit is formed from copper and the substrate is a plastics film such as a mylar film. Flexible circuits have many applications including the wiring behind fascias in vehicles.

SUMMARY OF THE INVENTION

According to the present invention there is provided a printed circuit connector adapted to be connected to at least one printed circuit, wherein said connector is provided with at least one spark gap for discharging excessive voltage, e.g. a surge in voltage, occurring in the printed circuit.

Preferably the connector is provided with contact means for electrical connection with the printed circuit. The contact means may comprise a plurality of connector contacts each adapted to engage a respective contact of the printed circuit; for example, 22 contacts would be provided in a 22 way connector, and 34 contacts would be provided in a 34 way connector.

Desirably the connector is provided with a body, associated with the connector contacts, for holding the contact means in position. The body is of a suitable insulating material and conveniently may be moulded from a suitable plastics material such as nylon.

Preferably securing means is provided for securing the connector in a desired location. For example, when the connector is used in a vehicle the connector may be secured to part of the vehicle body.

The securing means preferably comprises a securing member (also of a suitable insulating material, conveniently the same material as the body) which is attached to the body. The securing member may be of elongate configuration, and may be provided with at least one aperture through which fixing means (such as a screw) can be passed to secure the connector in its desired position. Preferably two apertures are provided, one at each end of the securing member.

Preferably at least part of the contact means is sandwiched between the body and the securing member.

In order to discharge the excessive voltage the contact means is electrically connected to earth and is provided with a spark gap. To this end, it is preferred that the contact means further includes a plurality of discharge contacts which can be electrically connected to earth. Each discharge contact is desirably spaced from a respective connector contact by a distance corresponding to the desired spark gap; the desired spark gap will depend upon the level of voltage surge which it is desired to discharge.

Advantageously the discharge contacts are provided on or in the securing means. Preferably the discharge contacts are connected to a common conductor which is disposed within the securing means.

It is also advantageous that the discharge contacts are electrically connected to the or each aperture of the securing means. For example, the common conductor may be provided with a ring-shaped portion which extends around and into the aperture, and/or with a projection which extends into the aperture. This is particularly useful when the connector is secured to an object, such as a vehicle body or similar case framework, which is earthed, or the earthing part of a printed circuit, because it provides a simple way of earthing the contact means.

The body preferably includes two spaced substantially parallel walls between which the securing member is received; the securing member is desirably a tight, sliding, fit between said walls.

The connector contacts may be arranged to extend upwardly between said upstanding walls in at least one row, preferably two rows. The securing member can be provided with recesses in which the discharge contacts are disposed. When two rows of connector contacts are provided then the recesses can be provided along two opposing side walls of the securing member; said opposing side walls are in the tight-fit engagement with the spaced walls of the body.

Each discharge contact is desirably arranged so that it extends from the securing member in said recesses towards its respective connector contact.

The securing means may be formed by integrally moulding the securing member with an electrical conductor assembly having a central conductor, having transverse conductors extending transversely to the central conductor at spaced intervals along the central conductor, and having side conductors also connected to the transverse conductors and running substantially parallel to the central conductor. The central conductor and part of each transverse conductor is disposed in or on the securing member.

The conductor assembly can then be severed so that the side conductors and part of each transverse conductor are removed. The conductor assembly is severed at such a position that when the securing member is disposed on the body of the connector, the desired spark gap is set between the circuit contacts and the transverse conductors. Thus, the transverse conductors correspond to the discharge contacts and the central conductor corresponds to the common conductor.

BRIEF DESCRIPTION OF THE DRAWINGS

Reference is now made to the accompanying drawings, in which.

DESCRIPTION OF THE PREFERRED EMBODIMENT

Figure 1:
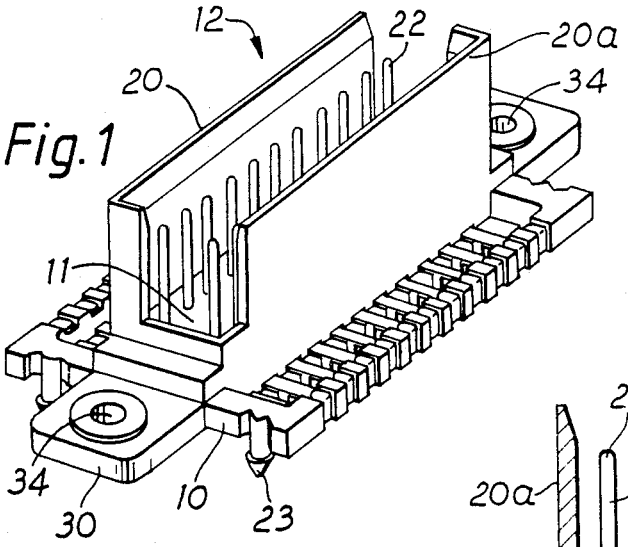
FIG. 1 is a perspective view from above, showing a printed circuit connector embodying the invention.
Figure 3:
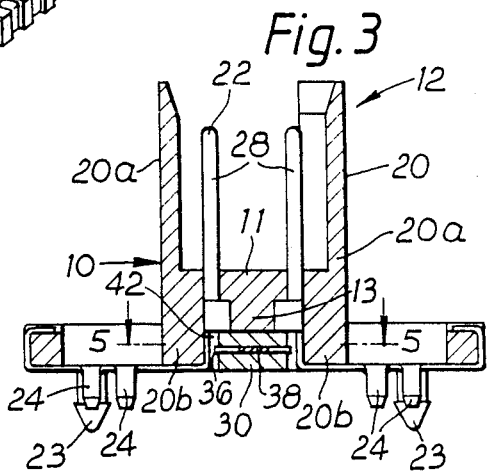
FIG. 3 is a cross-sectional view of the printed circuit connector embodying the invention.
Figure 2:
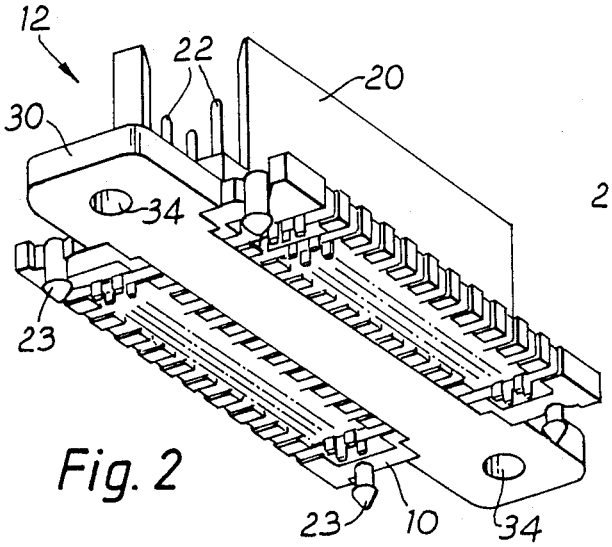
FIG. 2 is a perspective view from below, showing the printed circuit connector embodying the invention.
Figure 4:
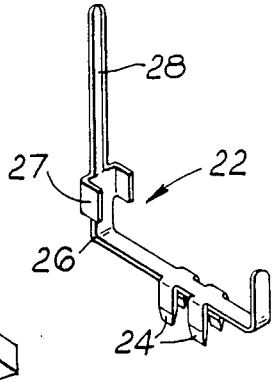
FIG. 4 is a perspective view of a circuit contact of the printed circuit connector embodying the invention.

In FIGS. 1 to 4 a body 10 of a printed circuit connector 12 is shown. The body 10 is formed of Nylon 66 by injection moulding.

The body 10 includes spaced walls 20 connected by a web 11; the walls 20 extend substantially parallel to one another.

The connector 12 is also provided with contact means which includes a plurality of connector contacts 22. The connector 12 is a twenty two way connector, therefore twenty two connector contacts 22 have been provided.

Each contact 22 includes first terminals 24 capable of puncturing the substrate of a flexible printed circuit (not shown). Each contact 22 also includes portions 22, 27 sandwiched between the body 10 and securing means in the form of an elongate securing member 30. The contacts 22 each further include an upstanding second terminal 28, the second terminals 28 being disposed substantially parallel to an upper portion **20*a* of the walls 20. The second terminals 28 are male connectors providing part of a plug connector; however in a connector in accordance with the invention otherwise similar to the connector shown in the drawings the second terminals may be female connectors, if desired. The second terminals 28 project through the web 11 of the body 10**.

The body 10 is provided with locating means, namely lugs 23, by which the body may be located accurately on a substrate, for example a flexible printed circuit, with the first terminals 24 in register with corresponding terminal portions of conductors on the substrate so that the first terminals 24 engage the terminal portions when the connector 12 is assembled with the substrate and make an electrical connection therewith. Conveniently the lugs 23 engage in holes in the substrate which are positioned relative to the conductors to provide the necessary registration. Collars on the lugs 23 assist in retaining them in place in the holes.

The contacts 22 are arranged in two rows of eleven contacts, so that the upstanding terminals 28 form two rows between the walls 20. The portions 27 of the two rows are separated by a rib 13 on the web 11, the rib facilitating retention of the connector contacts 22 in position. The contacts 22 may be formed of tinned brass.

The securing member 30 is provided with opposed side walls 32, and is disposed between the walls 20 so that the side walls 32 form a tight-fit with a lower portion **20*b* of the walls 20. After the securing member 30 has been assembled with the body 10 it is attached to the body 10 by an ultrasonic welding operation so that the parts cannot become separated during use. Alternatively the body 10 and securing member 30 may be attached by means of a suitable adhesive or by spring clips (conveniently moulded integrally with the body 10 or member 30**) if desired.

At each end of the securing member 30 there is provided an aperture 34 through which fixing means in the form of a fixing screw (not shown) may be passed in order to secure in position the securing member 30, together with the rest of the connector 12.

The contact means also includes a plurality of discharge contacts 36 which are secured to a common conductor 38 which runs within the securing member to the apertures 34. The common conductor 38 is provided with earthing contacts 40 which extend into the apertures 34.

Figure 5:
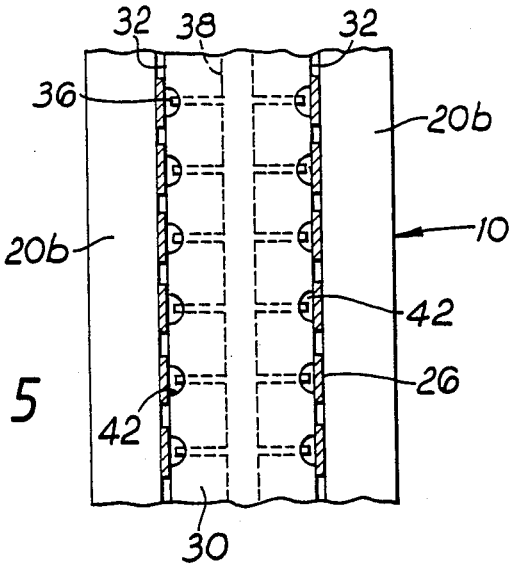
FIG. 5 is a cross-sectional view on an enlarged scale along lines 5—5 of FIG. 3.

The side walls 32 of the securing member 30 are provided with a plurality of recesses 42, and the discharge contacts 36 extend from the side walls 32 into the recesses 42. As shown in FIG. 5, when the support member 30 is disposed between the lower portions **20*b* of the walls 20, the portions 26 of the contacts 22 are spaced from the discharge contacts 36 by the walls 32. Thus, the walls 32 hold the contacts 22 at the correct spacing from the discharge contacts 36. The tight fit between the walls 32 and 20*b* serves to hold the contacts firmly in the vertical orientation. As shown, the presence of the contacts 22 may actually prevent the side walls 32 from engaging the walls 20*b***.

The upstanding terminals 28 and the discharge contacts 36 thus are spaced from each other to define a spark gap therebetween. The larger the spark gap, the greater the voltage required for a spark to jump the gap. Thus, the spark gap is set to the required distance to discharge all surges in voltage above a predetermined value.

The connector 12 can be secured to an object (not shown) which is itself earthed so that earthing takes place through the securing member 30 to the object. For example, when the connector is used in vehicles, it can be connected directly to the vehicle body.

Figure 6:
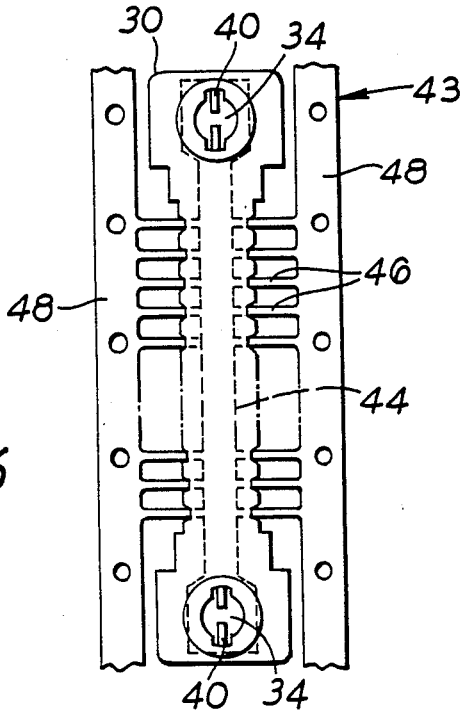
FIG. 6 is a plan view showing a method of forming securing means for the printed circuit connector embodying the invention.

FIG. 6 illustrates a method of forming the securing member 30. The securing member 30 is integrally moulded with an electrical conductor assembly 43 which comprises a central conductor 44, a plurality of transverse conductors 46 arranged at spaced intervals along the central conductor 44, and two side conductors 48 connected to the transverse conductors 46 and substantially parallel to the central conductor 44.

The transverse conductors 46 are severed at a position necessary to set the desired spark gap between the discharge contacts 36 and the upstanding terminals 28. After the transverse conductors 46 have been severed, the side conductors 48, together with the portion of the transverse conductors 46 still attached to the side conductors 48, are removed. The portion of the transverse conductors 46 still attached to the central conductor 44 form the discharge contacts 36; the central conductor 44 provides the common conductor 38.

The provision of a connector according to the invention, with an integral spark gap of suitable size, can discharge any desired surge in voltage including static charges.

I claim:

1. A printed circuit connector comprising contact means provided with a plurality of spark gaps, the connector comprising an insulating body comprising two spaced substantially parallel rectilinearly extending walls, a plurality of connector contacts associated with the body each comprising a first terminal adapted to engage a respective contact of a printed circuit with which the connector is to be used and a second terminal for engaging a mating connector, securing means comprising a securing member molded of insulating material with a common conductor molded therein, said common conductor having integral discharge contacts including end portions remote from the common conductor which end portions project into recesses in the securing member, the securing member being adapted to be received as a tight sliding fit between a lower portion of the walls of the body and to be attached to the body whereby to hold the connector contacts between said securing member and said lower portion of the walls with said second terminals positioned between portions of said walls upstanding from the body projecting from the side opposite said lower portion and with each connector contact passing through one of said recesses in which said end portion of an associated one of said discharge contacts is disposed spaced from the end portion of the associated discharge contact by a distance corresponding to a desired spark gap.

2. A printed circuit connector according to claim 1 wherein the body is moulded of plastics material.

3. A printed circuit connector according to claim 1 wherein the securing member is moulded of plastics material.

4. A printed circuit connector according to claim 1 comprising fixing means associated with the securing member by which the connector can be secured in a desired position.

5. A printed circuit connector according to claim 4 wherein the securing member comprises at least one aperture through which the fixing means can pass to secure the connector.

6. A printed circuit connector according to claim 1 comprising means by which the common conductor can be connected to earth.

7. A printed circuit connector according to claim 1 comprising fixing means by which the connector can be secured in a desired position and by which the common conductor can be connected to earth.

8. A connector according to claim 1 wherein said first terminals are capable of puncturing the substrate of a flexible printed circuit.

9. A connector according to claim 1 wherein the body comprises locating means by which the body may be located accurately on a substrate with the first terminals in register with corresponding terminal portions of conductors on the substrate.

* * * * *